US005806750A

United States Patent [19]

Yamanushi et al.

[11] Patent Number: 5,806,750

[45] Date of Patent: Sep. 15, 1998

[54] AUTOMATIC STAPLING DEVICE

[75] Inventors: Satoshi Yamanushi, Nirasaki; Takashi Yamamoto, Kofu, both of Japan

[73] Assignee: Nisca Corporation, Yamanashi-ken, Japan

[21] Appl. No.: 751,404

[22] Filed: Nov. 18, 1996

[30] Foreign Application Priority Data

Nov. 16, 1995 [JP] Japan ..... 7-322345

[51] Int. Cl.[6] ..... B27F 7/19

[52] U.S. Cl. ..... 227/155; 227/131

[58] Field of Search ..... 227/131, 129, 227/110, 155, 143

[56] References Cited

U.S. PATENT DOCUMENTS 5,005,751 4/1991 Radtke et al. ..... 227/155
5,092,509 3/1992 Naito et al. ..... 227/100
5,346,114 9/1994 Udagawa et al. ..... 227/155
5,413,266 5/1995 Jairam ..... 227/155
5,460,314 10/1995 Udagawa ..... 227/155

*Primary Examiner*—Scott A. Smith
*Attorney, Agent, or Firm*—Kane, Dalsimer, Sullivan, Kurucz, Levy, Eisele and Richard, LLP

[57] ABSTRACT

In a stapling device capable of automatically inserting one or more staples into piled sheets discharged from an image producing device or the like to bind the sheets, a staple driver unit for inserting the staple into the sheet and a clinching unit for bending the leg parts of the staple piercing the sheets are opposed to each other astride a sheet passage and operated to perform stapling by a simple stapling drive having a single power source. By operating the staple driver unit and the clinching unit by the single power source, the precise and stable stapling operation can be carried out with exquisite timing without using a high-level controlling system.

17 Claims, 10 Drawing Sheets

AUTOMATIC STAPLING DEVICE

BACKGROUND OF THE INVENTION

1. Field of the Invention

This invention relates to a stapling device for automatically binding a plurality of sheets with one or more staples, and more particularly, to an automatic stapling device capable of rationally and stably operating a staple driver unit and a clinching unit, which are opposed to each other across a sheet passage, by a single drive mechanism.

2. Description of the Prior Art

There have been so far provided various staplers for automatically binding sheets with a staple or staples. The stapler of the type to be applied to an image producing device such as a printer is generally attached to a sheet discharge portion of the image producing device so as to receive sheets discharged from the image producing device and automatically drive one or more staples into points prescribed on the sheets, thus binding the sheets.

In a system described in U.S. Pat. No. 4,720,033 to Olesen, a stapler composed of a staple driver united with a hinged anvil for clinching needle legs of a staple piercing the piled sheets is disposed on a sheet discharge passage. Upon binding the sheets with the staples by the stapler in this conventional system, the stapler is required to recede from the sheet passage so as not to prevent the piled sheets stapled by the stapler from passing through the sheet discharge passage for discharging the stapled sheets. As one possible way for overcoming such a disadvantage, attempts are being made to vertically separate the anvil from the staple driver astride the sheet passage, as described in Japanese Patent Application Public Disclosure No. 2-219601(A) and Japanese Utility Model Application Public Disclosure No. 6-63342(A).

Furthermore, in Japanese Utility Model Appln. Public Disclosure No. 6-63342(A), the anvil for bending inwardly the needle legs of a staple piercing the sheets includes clinching means for flattening the the needle legs passing through the sheets, consequently to neatly finish the binding of the sheets.

However, the stapler having the staple driver and clinching unit separated vertically necessitates a means for severally operating and controlling the staple driver and clinching unit, which commonly incorporates a plurality of electrical drive mechanisms such as electric motors and solenoids for independently operating the staple driver and clinching unit, as proposed by the aforesaid Japanese Utility Model Appln. Public Disclosure No. 6-63342(A).

In addition to the driving mechanisms for the respective staple driver and clinching unit, the automatic stapling device of this type further calls for one or more means for synchronously moving the separated staple driver and clinching unit in the width direction of the sheet, which is perpendicular to the sheet forwarding direction, so that the staples can be inserted into arbitrary stapling positions prescribed on the sheets to be bound in a sheaf. Therefore, the conventional automatic stapling device inevitably requiring three or more drive mechanisms including motors turns out to be complicated in structure and results in a large overall size, thus rendering the handling and maintenance of the device difficult and raising the cost of product. Besides, the separated staple driver and clinching unit in the conventional device have to be operated in concert with each other, whereas the device requires a complicated servo system capable of highly controlling and precisely operating the independent drive mechanisms synchronously. The conventional device thus complicated is difficult of stable operation for a long period of time and was not always used preferably as one element of general purpose systems.

OBJECT OF THE INVENTION

One object of the present invention is to provide an automatic stapling device capable of precisely and stably operating a staple driver unit and a clinching unit, which are separated from each other and must be driven independently in themselves, by using a single common driving means.

Another object of the invention is to provide an automatic stapling device having no need for driving means reliant on a complicated control system including a high-level servo mechanism for driving the staple driver unit and the clinching unit, so that the stable stapling operation can be performed for a long time.

Still another object of the invention is to provide an automatic stapling device capable of being easily attached to a sheet discharge portion of an image producing device such as a printer and a copying machine so as to arrange the sheets discharged from the image producing device in order, and automatically inserting one or more staples into stapling points prescribed on the piled sheets, thus enabling the device to be handled easily and maintained suitably.

SUMMARY OF THE INVENTION

To attain the objects described above according to the present invention there is provided an automatic stapling device comprising a staple driver unit for inserting a staple into piled sheets, a clinching unit opposed to the staple driver unit across a sheet passage so as to bend the leg parts of the staple piercing the sheets, stapling drive means incorporating a single power source so as to operate the staple driver unit so as to insert the staple into the sheets and the clinching unit so as to clinch the leg parts of the staple, and means for transmitting motive power produced by the stapling drive means to the staple driver unit and clinching unit.

The staple driver unit and clinching unit are synchronously moved parallel toward a prescribed stapling position by position setting means, so that the staple driver unit and clinching unit being placed in the stapling position are operated by the stapling drive means to perform the desired stapling operation.

The staple driver unit and the clinching unit are slidably supported by parallel guide rods opposed to each other across the sheet passage and secured between opposite device frames.

The position setting means for synchronously moving parallel the staple driver unit and clinching unit incorporates two lead screw rods held between the device frames. By rotating the lead screw rods selectively in one of forward and reverse directions by use of a single feed drive means, the staple driver unit and clinching unit can be synchronously moved in either forward or reverse direction to their prescribed stapling position.

The stapling drive means for severally operating the staple driving mechanism of the staple driver unit and the clinching mechanism of the clinching unit includes a staple driving power source having a single motor for outputting rotational motion through transmission means, and drive shafts slidably passing through the respective staple driver unit and clinching unit, which are connected to the staple driving power source through transmission means and supported parallel between the device frames.

According to the structure as noted above, the staple driver unit and clinching unit can be rationally operated at a high speed by the single staple driving power source, thus making the device simple in structure and light in weight.

Other objects and features of the present invention will be described in detail hereinafter with reference to the accompanying drawings.

DESCRIPTION OF THE PREFERRED EMBODIMENTS

This invention is related to a stapling device applicable to an image producing device such as a printer and a copying machine. The stapling operation of the stapling device which is attached to the image producing device for automatically binding piled sheets discharged from the image producing device can be stably fulfilled by simple driving mechanisms.

Figure 1:
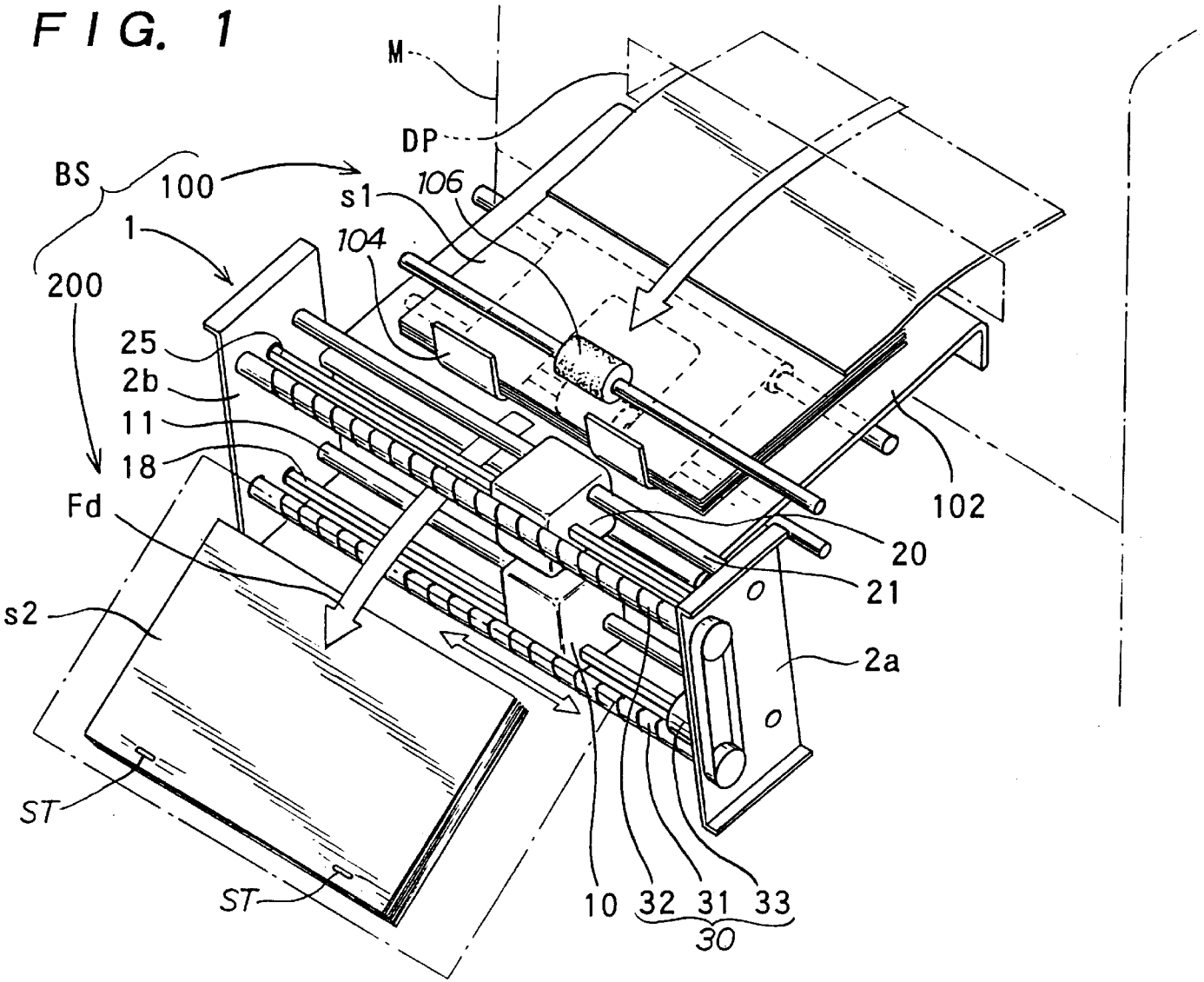
FIG. 1 is a perspective view schematically showing one application of an automatic stapling device according to this invention to an image producing device.

As illustrated in FIG. 1 by way of example, the stapling device 1 of the invention may be used as one element of a finishing system or bookbinding system BS disposed on a sheet discharge portion DP of the image producing device M.

This finishing system BK includes the stapling device 1 according to the invention, a collating device 100 disposed between the stapling device 1 and the image producing device M for putting the sheets s1 discharged from the image producing device M in order, and a finish stacker 200 for containing finished sheets s2 which have been stapled by the stapling device 1.

The collating device 100 comprises a collector tray 102, a retractable stopper 104 for truing up the leading ends of the piled sheets s1 discharged from the image producing device M to the collector tray 102 and temporarily restraining the sheets from advancing, and sheet forwarding means 106 formed of rollers for transferring the piled sheets to the stapling device 1 and placing the sheets in a stapling position.

When the leading end part of the piled sheets sent out from the collating device 100 arrives at the stapling position of the stapling device 1, the stapling device 1 is operated to insert one or more staples ST into one or more stapling points prescribed on the leading end part of the piled sheets. Thereafter, the finished sheaf of sheets s2 thus stapled is sent out in the sheet forwarding direction Fd to the finish stacker 200.

The collating device 100 and finish stacker 200 which constitute the aforenoted finish system BK are not specifically novel in the field of art, and the present invention does not contemplate imposing any limitation on the applicability of the stapling device of the invention to a specific system. Thus, the description of these specific component elements is omitted below.

Figure 2:
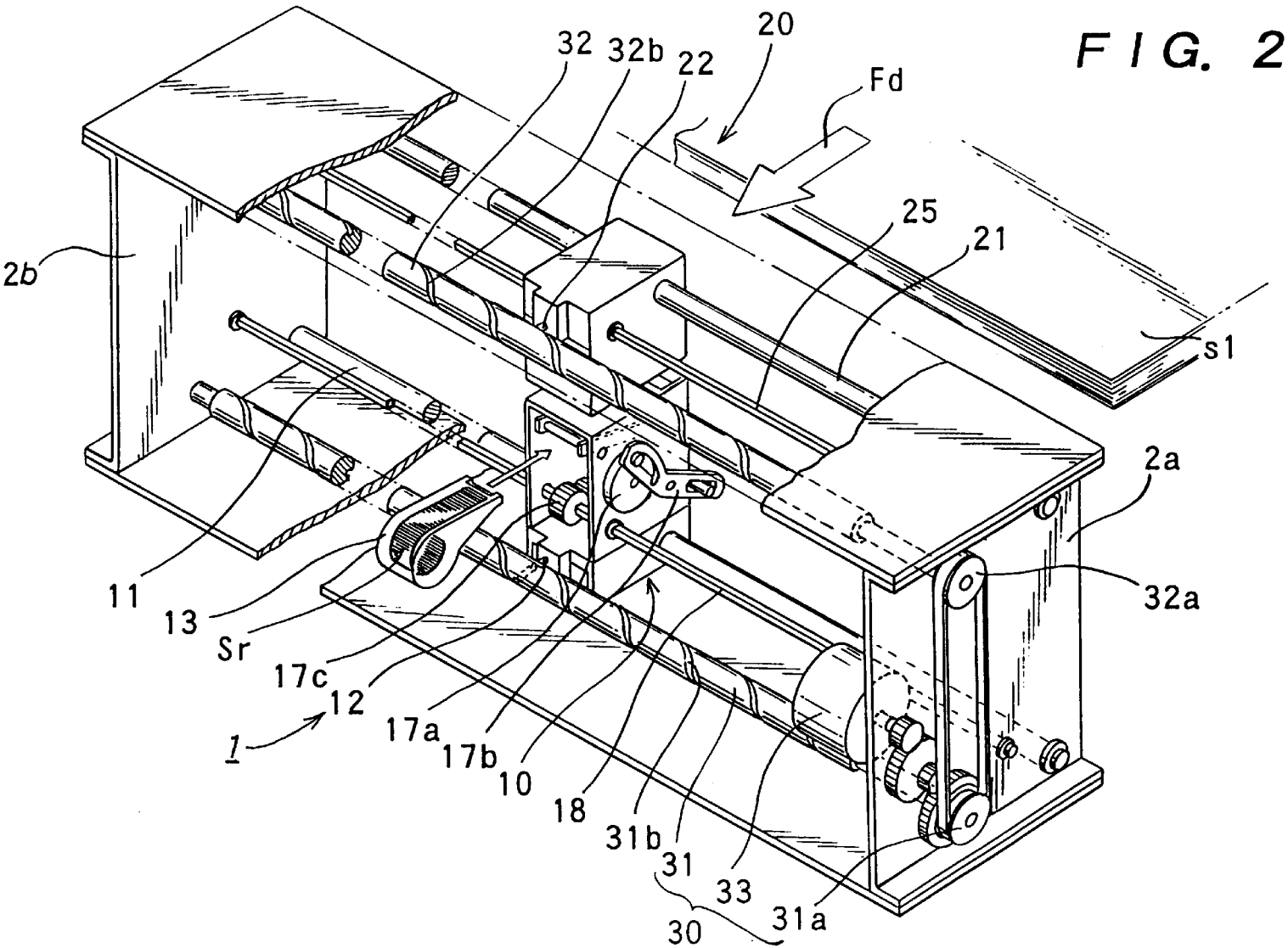
FIG. 2 is a partial cutaway perspective view schematically showing one embodiment of the automatic stapling device of the invention.
Figure 3:
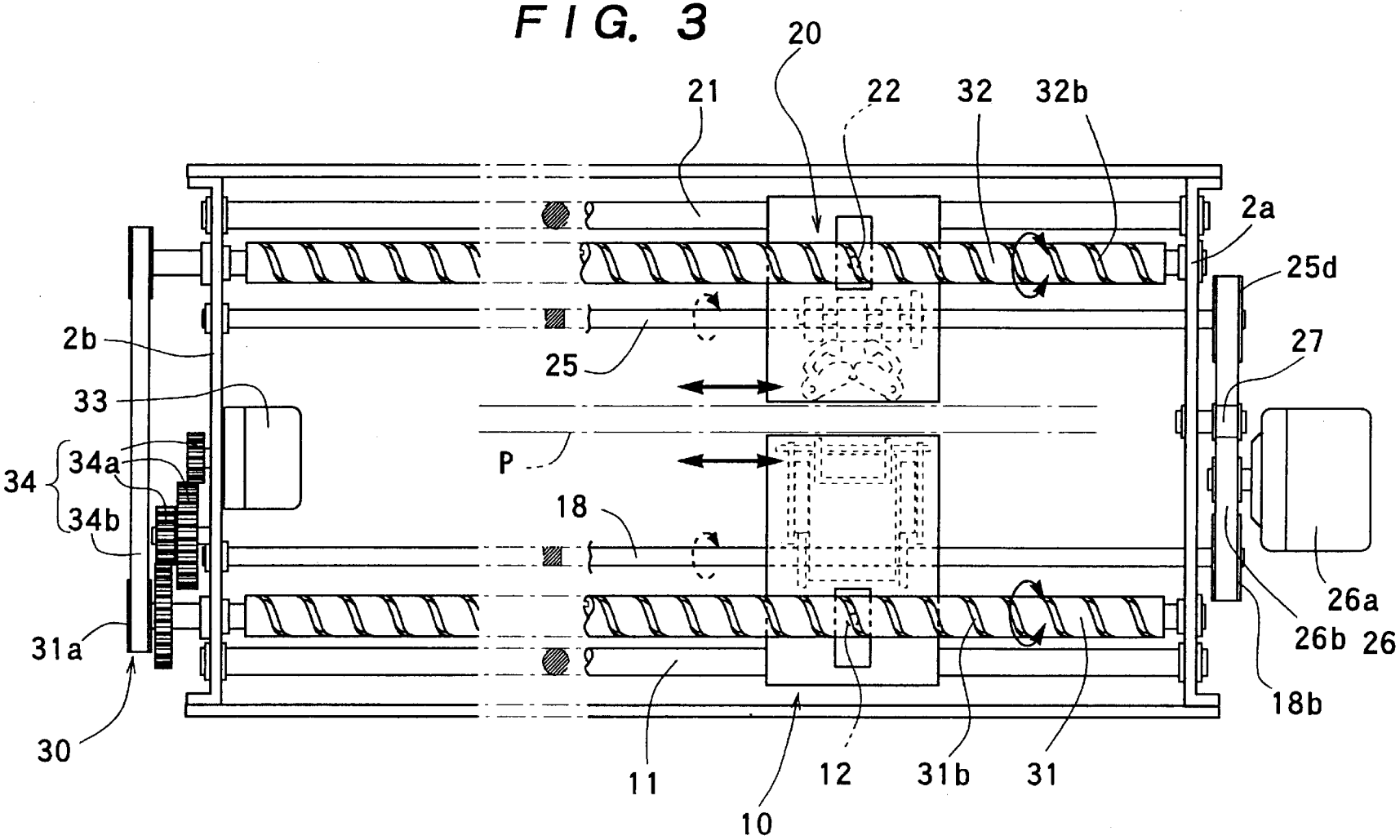
FIG. 3 is a front view schematically showing the device of FIG. 2.

The stapling device 1 includes a staple driver unit 10 and a clinching unit 20 which are opposed to each other astride a sheet passage P as shown in FIG. 2 and FIG. 3.

The staple driver unit 10 and clinching unit 20 always face each other, so that leg parts of a staple ST discharged from the staple driver unit 10 are caught and bent by the clinching unit 20, thus binding the sheets interposed between the staple driver unit 10 and the clinching unit 20.

The staple driver unit 10 and clinching unit 20 are movable parallel in the direction perpendicular to the sheet forwarding direction Fd while leaving a regular space serving as the sheet passage P between the staple driver unit and clinching unit kept in a state facing each other. The staple driver unit and clinching unit each are slidably supported by at least one driver guide rod 11 and at least one clinch guide rod 21, which are secured parallel to each other between side panels 2*a* and 2*b* of a device frame.

The stapling device further includes position setting means 30 for parallel moving the staple driver unit 10 and clinching unit 20 along the guide rods 11 and 12 and placing those units in the stapling position prescribed on the piled sheets s1.

The position setting means 30 comprises lead screw rods 31 and 32 for respectively moving the staple driver unit and clinching unit synchronously, which are rotatably mounted between the side panels 2*a* and 2*b* in parallel to the guide rods 11 and 21, a power source 33 such as an electric motor for generating rotational motion to rotate the lead screw rods 31 and 32, and means 34 for transmitting the rotational motion generated by the power source 33 to the lead screw rods 31 and 32.

The lead screw rods 31 and 32 are provided on their one ends with timing wheels 31*a* and 32*a*, respectively, so that the rotational motion can be transmitted to the timing wheels 31*a* and 32*a* through the motion transmission means 34 including a series of transmission gears 34*a* and a timing belt 34*b*.

The lead screw rods 31 and 32 have respective spiral grooves 31*b* and 32*b* for receiving slider pins 12 and 22 disposed on the staple driver unit 10 and clinching unit 20, so that the staple driver unit 10 and clinching unit 20 can move parallel along the lead screw rods 31 and 32 and guide rods 11 and 21 across the sheet passage P by rotating the screw rods 31 and 32.

Figure 4:
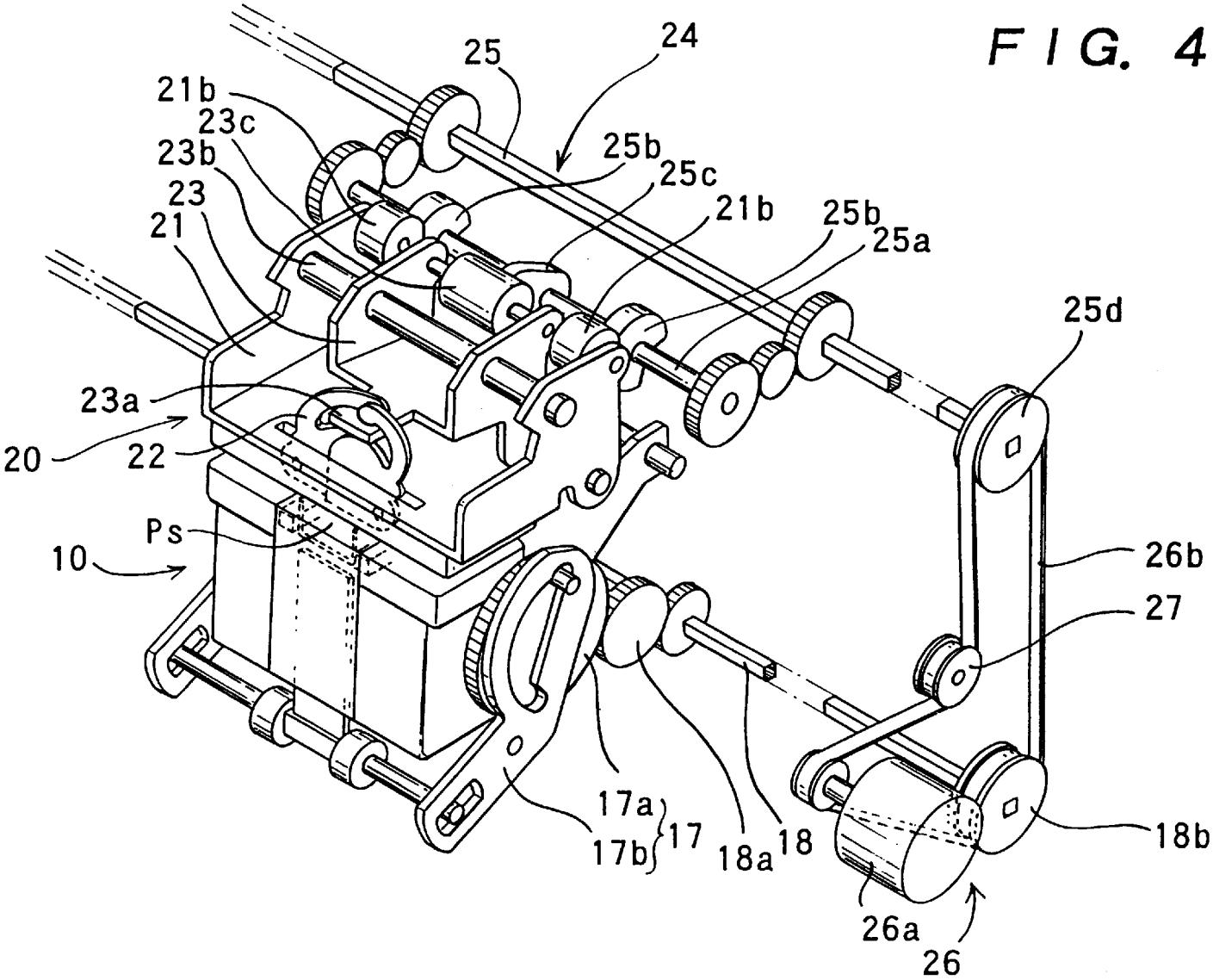
FIG. 4 is an enlarged perspective view schematically showing the staple driver unit and clinching unit in the device of FIG. 2.
Figure 5:
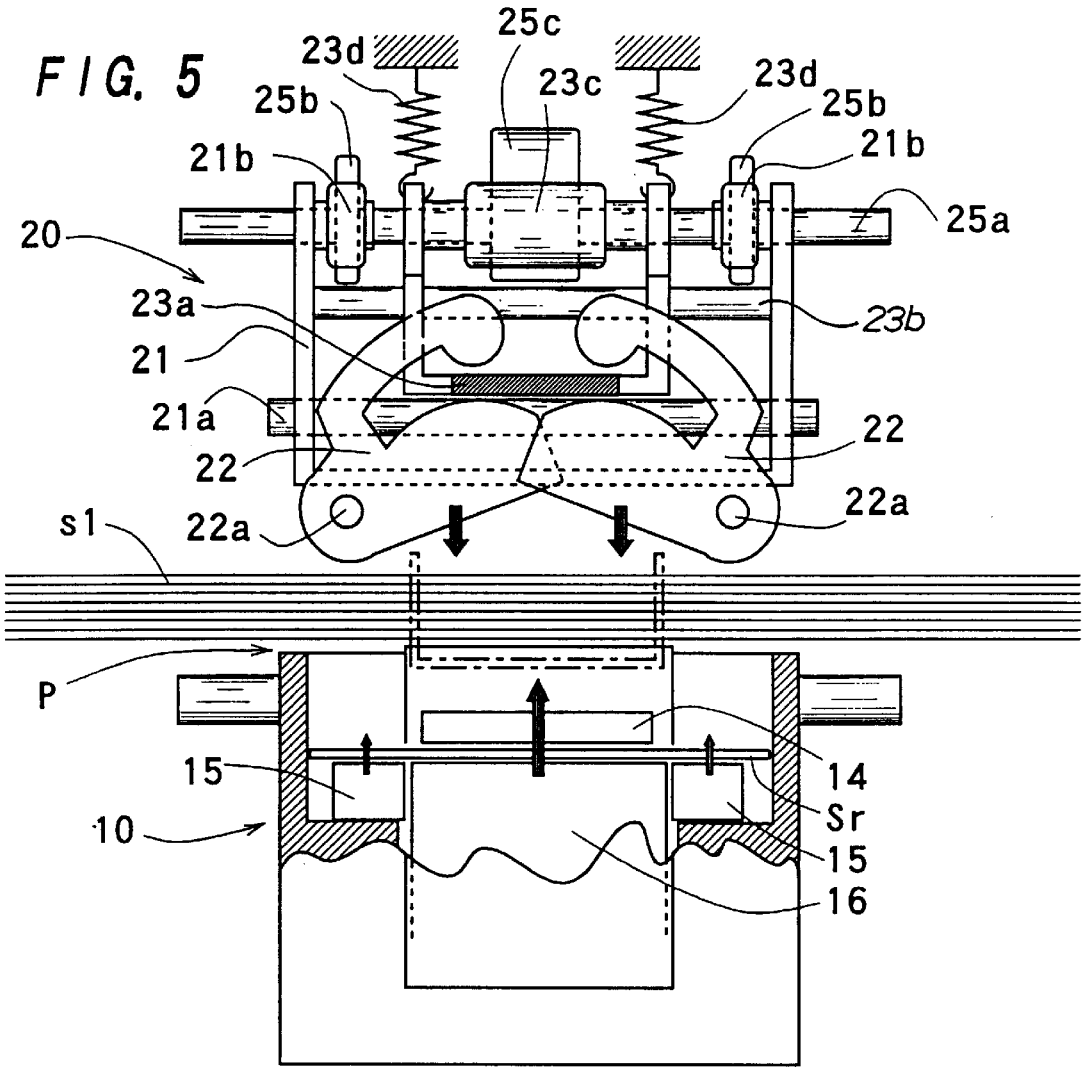
FIG. 5 shows a schematic front view in explanation of the stapling, principle of the device of FIG. 2.

As shown in FIG. 2, FIG. 4 and FIG. 5, the staple driver unit 10 includes an element wire cartridge 13 for containing a belt into which lots of short element wires Sr to be used as a materials for a staple ST are joined, a retractable shaping support block 14 for stopping one element wire Sr from the element wire cartridge 13, a substantially fork-shaped punch member 15 capable of moving downward so as to shape the element wire Sr supported by the support block 14 into a staple ST in a substantially square bracket (]) or a substantially U, and a staple driving blade 16 for striking the substantially square bracket-shaped staple ST on the clinching unit 20.

The staple driving blade 16 is driven by a driver operating means 17 including a cam wheel 17*a* and a cam lever 17*b* rockingly movable with the rotation of the cam wheel 17*a*. The cam wheel 17*a* is given rotational motion through a driver rotating shaft 18 and transmission means 18*a* such as gears. The shaping support block 14 and the punch member 15 are also driven through the medium of the driver rotating shaft 18 and gears 17*c*.

Figure 8A:
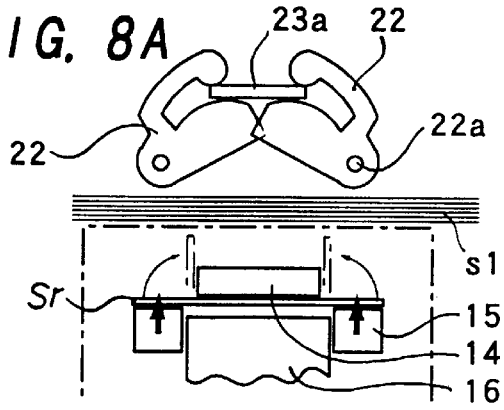
FIG. 8A through FIG. 8D are front views showing the sequence of stapling operation of the device of FIG. 2.

At the commencement of stapling the sheets by the staple driver unit 10, the piled sheets s1 to be bound is first placed between the staple driver unit 10 and the clinching unit 20. In this initial state, the punch member 15 and the staple driving blade 16 are held in their stand-by positions apart from the sheet passage P in a non-operation state, and the element wire Sr from the element wire cartridge 13 is retained by the support block 14 (FIG. 5 and FIG. 8A).

Figure 7A:
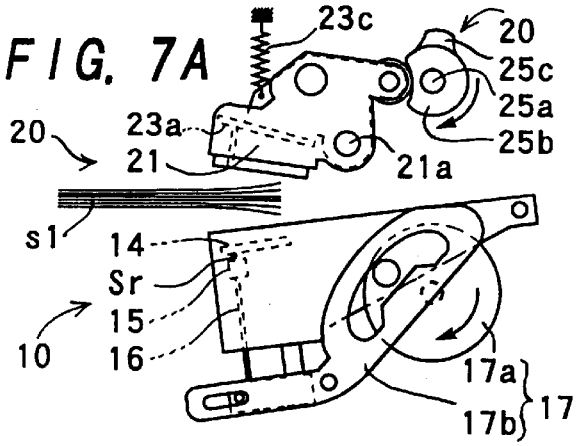
FIG. 7A through FIG. 7D are side views showing the sequence of stapling operation of the device of FIG. 2.

Next, the cam wheel 17*a* is rotated to have the cam lever 17*b* act on the punch member 15, thus thrusting the punch member 15 toward the clinching unit 20 as indicated by the arrow a1 in FIG. 5. Consequently, both end parts of the element wire Sr which protrude sideward from the support block 14 are pressed down and bent toward the clinching unit 20. As a result, the substantially square bracket-shaped staple ST can be formed (FIG. 7A and FIG. 8A). Then, the support block 14 is retracted to make way for the staple ST toward the clinching unit 20.

Figure 7B:
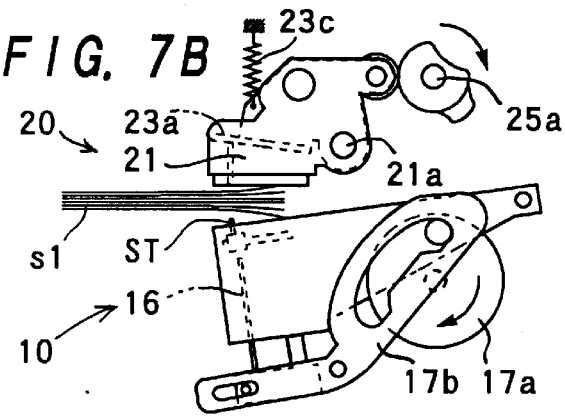
Figure 8B:
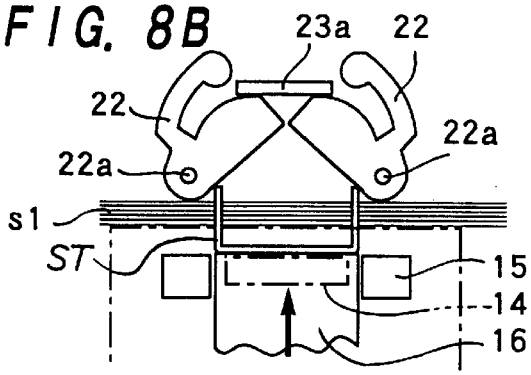

By further rotating the cam wheel 17*a*, the staple driving blade 16 is depressed toward the clinching unit 20 so that the staple ST is projected to the clinching unit, thus causing the leg parts of the staple to pass through the sheets s1 (FIG. 7B and FIG. 8B).

Figure 6:
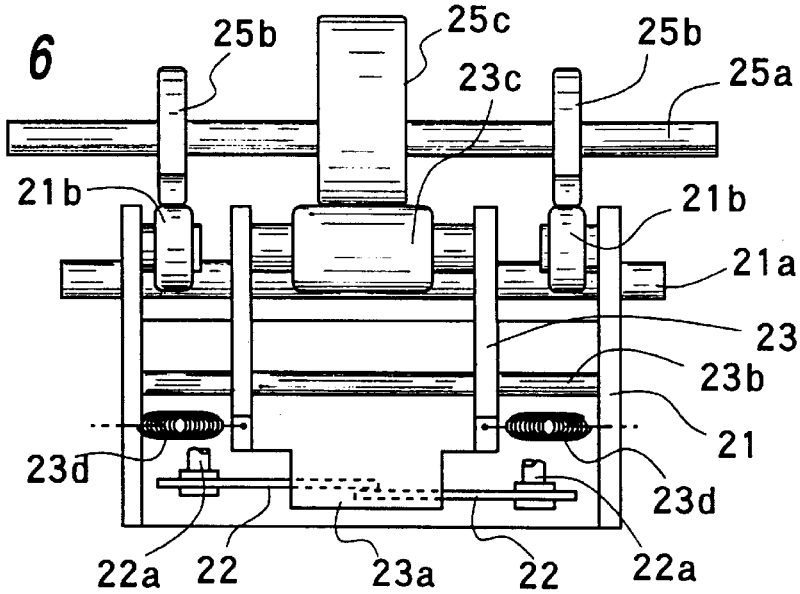
FIG. 6 is a plan view schematically showing the clinching unit of the device of FIG. 2.

In passing, the clinching unit 20 serving to bend the leg parts of the staple ST passing through the sheets s1 comprises an anvil base 21 pivotally supported by a rotating shaft 21*a*, a pair of leaping wings 22 rotatably supported by a shaft 22*a* on the anvil base 21, a clinching member 23 having a lever 23*a* for operating the leaping wings 22, which is rotatably supported by a rotating shaft 23*b* on the anvil base 21, and clinch driving means 24 for differentially operating the anvil base 21 and the clinching member 23, as shown in FIGS. 5 and 6.

The clinch driving means 24 includes rocking cams 25*b* supported by a shaft 25*a* so as to rotate with the rotation given by a clinch rotating shaft 25 for rocking the anvil base, and a wing rocking cam 25*c*. The cams 25*b* work on followers 21*b* mounted on the anvil base 21 to rockingly move the anvil base 21, and the cam 25*c* works on a follower 23*c* mounted on the clinching member 23 to rockingly move the clinching member 23.

The clinching member 23 is urged downward about the shaft 23*b* by springs 23*d* to bring the follower 23*c* in press contact with the rocking cam 25*c*. Thus, the clinching member 23 is rockingly moved in accordance with the circumferential configuration of the rocking cam 25*c* in rotation.

Since the clinching member 23 is retained by the shaft 23*b* on the anvil base 21 supported by the shaft 21*a*, the anvil base 21 is urged by the springs 23*d* to bring the followers 21*b* into press contact with the rocking cams 25*b*. Thus, when rotating the rocking cams 25*b*, the anvil base 21 is rockingly moved in accordance with the circumferential configuration of the cam 25*b*.

Each cam 25*b* supported by the shaft 25*a* has a round shape with a circular dent. When the follower 21*b* confronts the circular dent of the cam 25*b*, the anvil base 21 is urged upward by the springs 23*d* to rotate about the shaft 21*c* while moving the follower 21*b* backward. At this time, the staple driver unit 10 is separated from the clinching unit 20, thus making the sheet passage P broad.

On the other hand, the cam 25*c* suppored by the shaft 25*a* is provided on its circumferential surface with a protrusion, so that the clinching member 23 is rotated about the shaft 23*b* to bring the wing operating lever 23*a* into press contact with the leaping wings 22 when the protrusion of the cam 25*c* comes into contact with the follower 23*c*. Consequently, the anvil base 21 and clinching member 23 are operated differentially with the rocking cams 25*b* and 25*c* supported by the shaft 25*a* in conjunction with the aforesaid driver operating means 17.

Figure 7C:
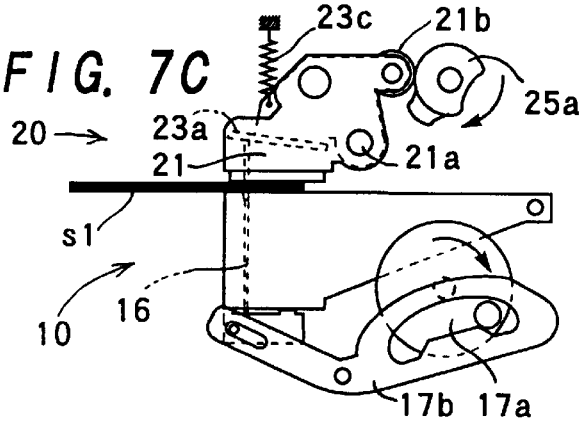
Figure 8C:
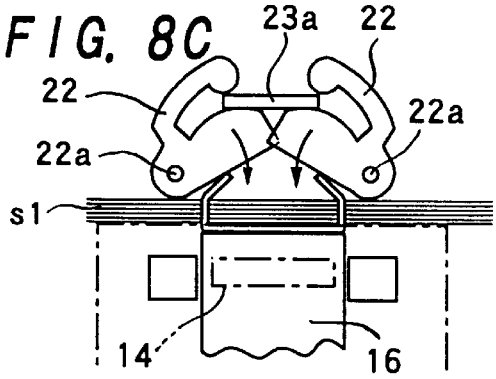

That is, when the staple ST is inserted into the sheets s1, the leg parts of the staple piercing the sheets s1 are stopped by the leaping wings 22 as shown in FIG. 7B and FIG. 8B, and then, the leaping wings 22 are rotated downward by rotating the cam 25*c* supported by the shaft 25*a* with the rotation of the clinch rotating shaft 25, thus acting on the follower 23*c* to tilt forward the clinching member 23, as a result of which the staple leg parts are clinched, as shown in FIG. 7C and FIG. 8C.

Figure 7D:
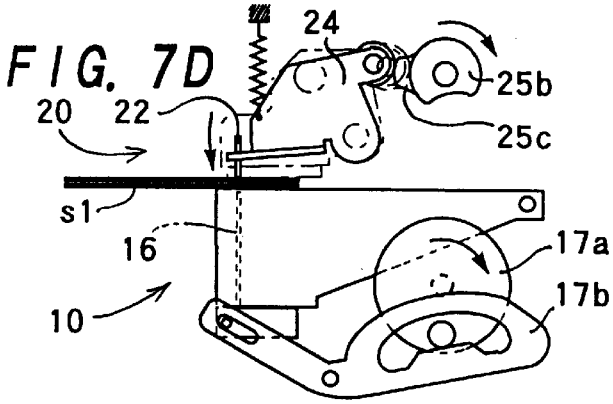
Figure 8D:
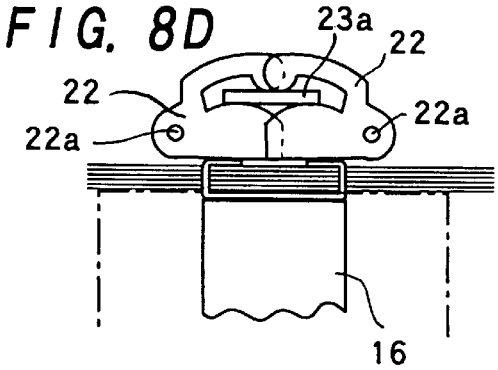

Thereafter, the driving blade 16 and leaping wings 22 occlude each other to completely bind the sheets s1 (FIG. 7D and FIG. 8D).

As mentioned above, the staple driver unit 10 and clinching unit 20 work in closer cooperation with each other with exquisite timing from the process of forming and thrusting the staple ST on the staple driver unit 10 to the process of clinching the leg parts of the staple ST as shown in FIG. 7A through FIG. 7D and FIG. 8A through FIG. 8D. For driving the separated staple driver unit 10 and clinching unit 20 with independent driving systems, a highly skilled technique must be essentially required, and besides, discrepancy in operation timing would inevitably occur in principle, whereas the stapling device of the present invention is free from such disadvantages, and can advantageously operate the staple driver unit 10 and clinching unit 20 by a single driving power source.

That is, in the device of the invention, as shown particularly in FIG. 3 and FIG. 4, the driver rotating shaft 18 for operating the staple driver unit 10 and the clinch rotating shaft 25 for operating the clinching unit 20 can be driven by a stapling drive means 26 with a single driving power source 26*a*, without causing discrepancy in operation timing between the staple driver unit and clinching unit. In this embodiment, the stapling drive means 26 adopts a single electric motor as the driving power source 26*a*, so that rotational motion generated by the power source 26*a* is transmitted to a timing wheel 18*b* secured on one end of the driver rotating shaft 18 through the timing belt 26*b* and a timing wheel 25*d* secured on one end of the clinch rotating shaft 25.

Denoted by 27 is a tension roller for imparting a tension force to the timing belt 26*b*.

As is noted from the foregoing, since the staple driver unit 10 and clinching unit 20 are operated by the stapling drive means 26 having the single power source 26*a*, they can be operatively associated with each other in complete concert with exquisite timing, thus stably fulfilling precise stapling operation. Although the driver rotating shaft 18 and the clinch drive shaft 25 each are formed of a square rod in the illustrated embodiment, so that rotational motion can be reliably transmitted respectively to the driver operating means 17 and the clinch driving means 24, these shafts are not always shaped in a square in section, and there may be used motion transmission means of any type.

Also, the electric motor serving as the power source 26*a* incorporated in the stapling drive means 26 is secured onto the outer side of the side panel 2*a* in this embodiment, but this structure should not be understood as limitative.

Figure 9:
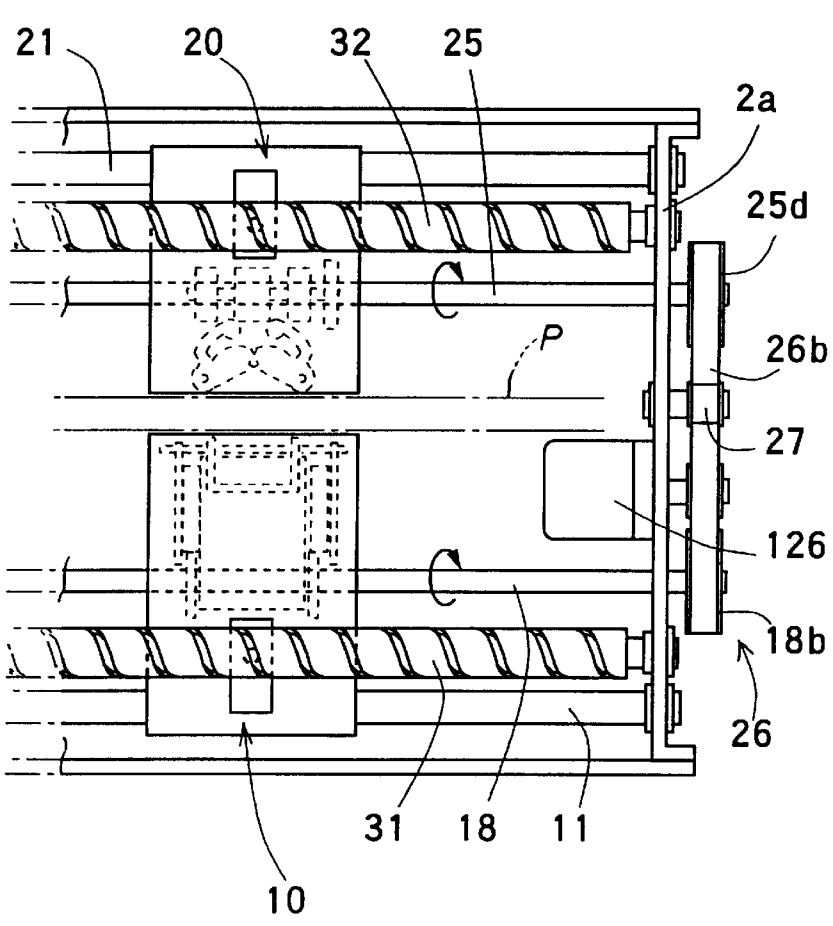
FIG. 9 is a front view schematically showing, in part, another embodiment of the present invention.

For instance, as shown in FIG. 9 as another embodiment, an electric motor 126 may be attached to the inner side of the side panel 2*a*. The other components appearing in this embodiment such as the timing belt 26*b* and tension roller 27 of the stapling drive means 26, the timing wheel 18*b* secured on one end of the driver rotating shaft 18, and the timing wheel 25*d* secured on one end of the clinch rotating shaft 25 are all identical or equal to the corresponding elements in the former first embodiment mentioned above.

In the embodiment of FIG. 9, the motor 126 may be preferably be disposed deviating as far as possible from the sheet passage P in the device frame. This embodiment is effective specifically in assembling the components into a limited space inside the device frame.

Figure 10:
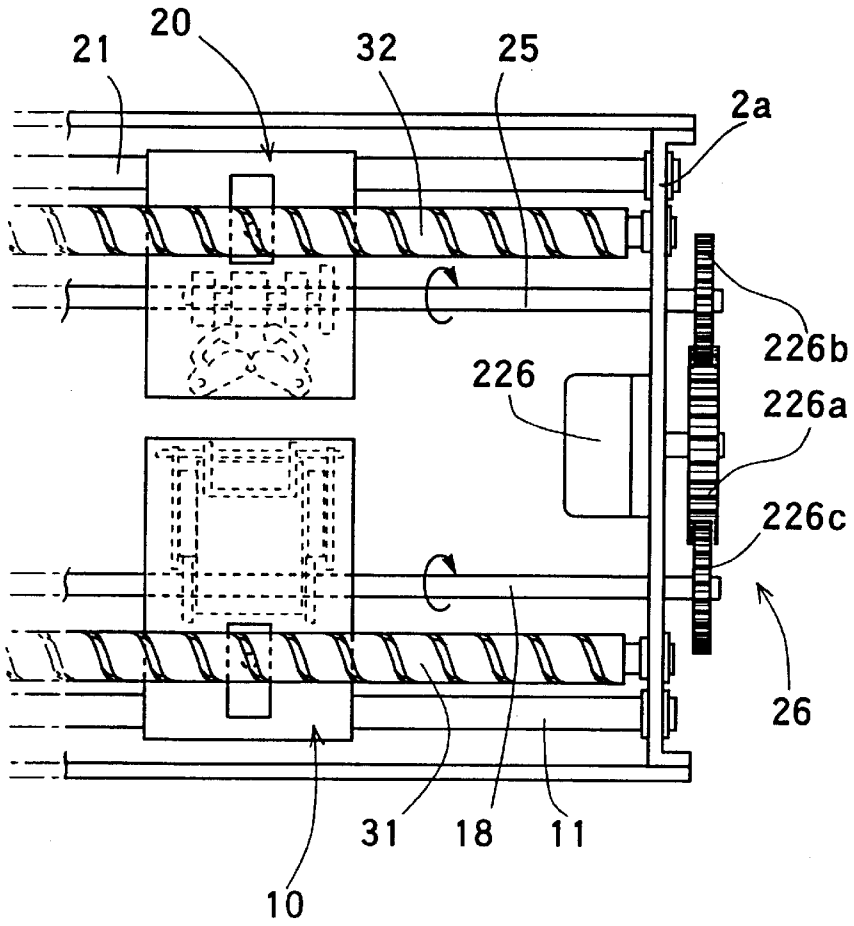
FIG. 10 is a front view schematically showing, in part, still another embodiment of the present invention.

The embodiment of FIG. 10 has the stapling drive means incorporating a series of gears 226 instead of the timing belt in the former embodiment. Thus, this and other components can be altered or modified as occasion calls. The other components are identical in structure and function with those in the former embodiment.

Figure 11:
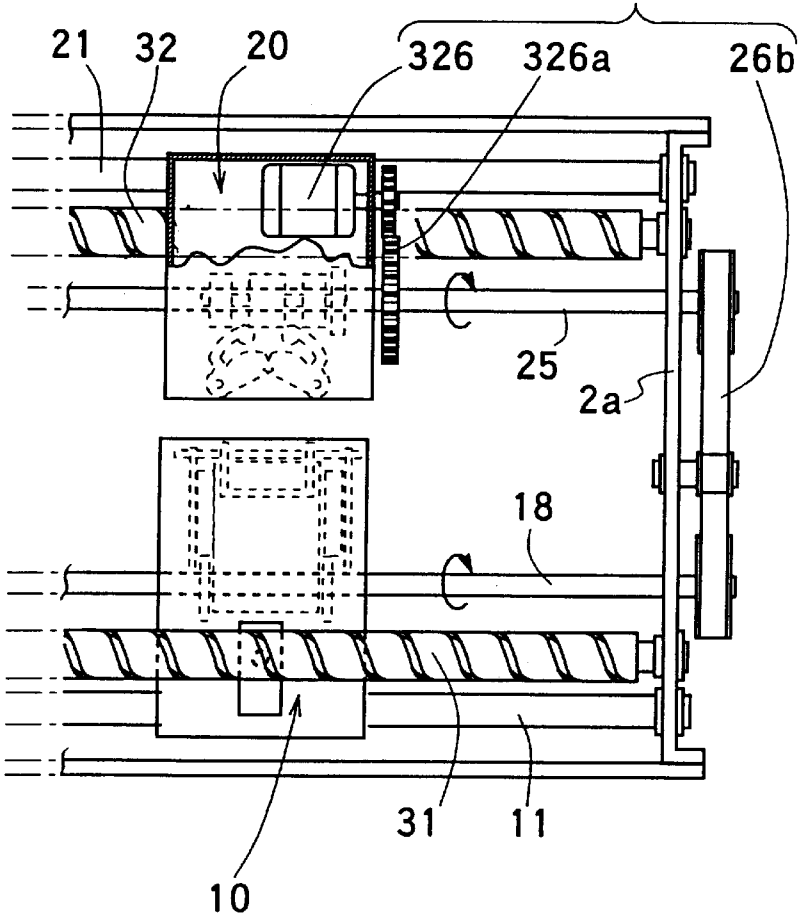
FIG. 11 is a front view schematically showing, in part, yet another embodiment of the present invention.

The embodiment shown in FIG. 11 has a single electric motor 326 incorporated in the clinching unit 20, which serves as a power source for the stapling drive means 26. In this embodiment, rotational motion generated by the electric motor 326 is transmitted to the clinch rotating shaft 25 through a driving gear 326*a*, a driven gear 326*b* disposed on the driver rotating shaft 18, and a driven gear 326*c* disposed on the clinch rotating shaft 25. The motion transmission from the rotating shaft 25 to the rotating shaft 18 is achieved by the timing belt 26*b* arranged along the side panel 2*a*. This embodiment can also be used depending on the conditions of usage and can bring about the same effect as the former embodiment.

Figure 12:
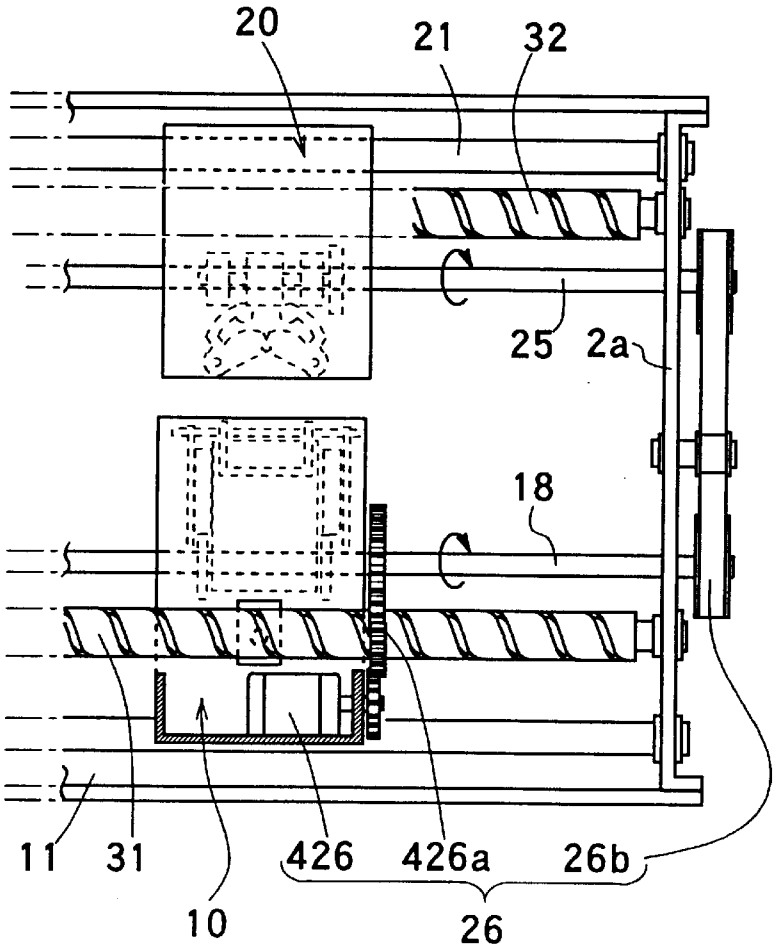
FIG. 12 is a front view schematically showing, in part, a further embodiment of the present invention.

The embodiment shown in FIG. 12 has an electric motor 426 incorporated in the staple driver unit 10, which serves as a power source for the stapling drive means 26. In this embodiment, rotational motion generated by the electric motor 426 is transmitted to the driver rotating shaft 18 through motion transmitting means 426*a* such as gears. The motion transmission from the rotating shaft 18 to the rotating shaft 25 is achieved by the timing belt 26*b* arranged along the side panel 2*a*. This embodiment can bring about the substantially same effect as the embodiment of FIG. 11.

Although the first embodiment described above has the staple driver unit 10 slidably supported by one guide rod 11 and the clinching unit 20 slidably supported by one guide rod 21, the number of such guide rods is not specifically limited. That is to say, each of those elements may be supported by more than one guide rod. For example, the staple driver unit 10 and clinching unit 20 may be slidably supported by parallel guide rods 511*a*, 511*b* and 521*a*, 521*b*, respectively. Of course, it is to be understood that the guide rods for respectively supporting the staple driver unit 10 and the clinching unit 20 are limited to a specific number.

Figure 13:
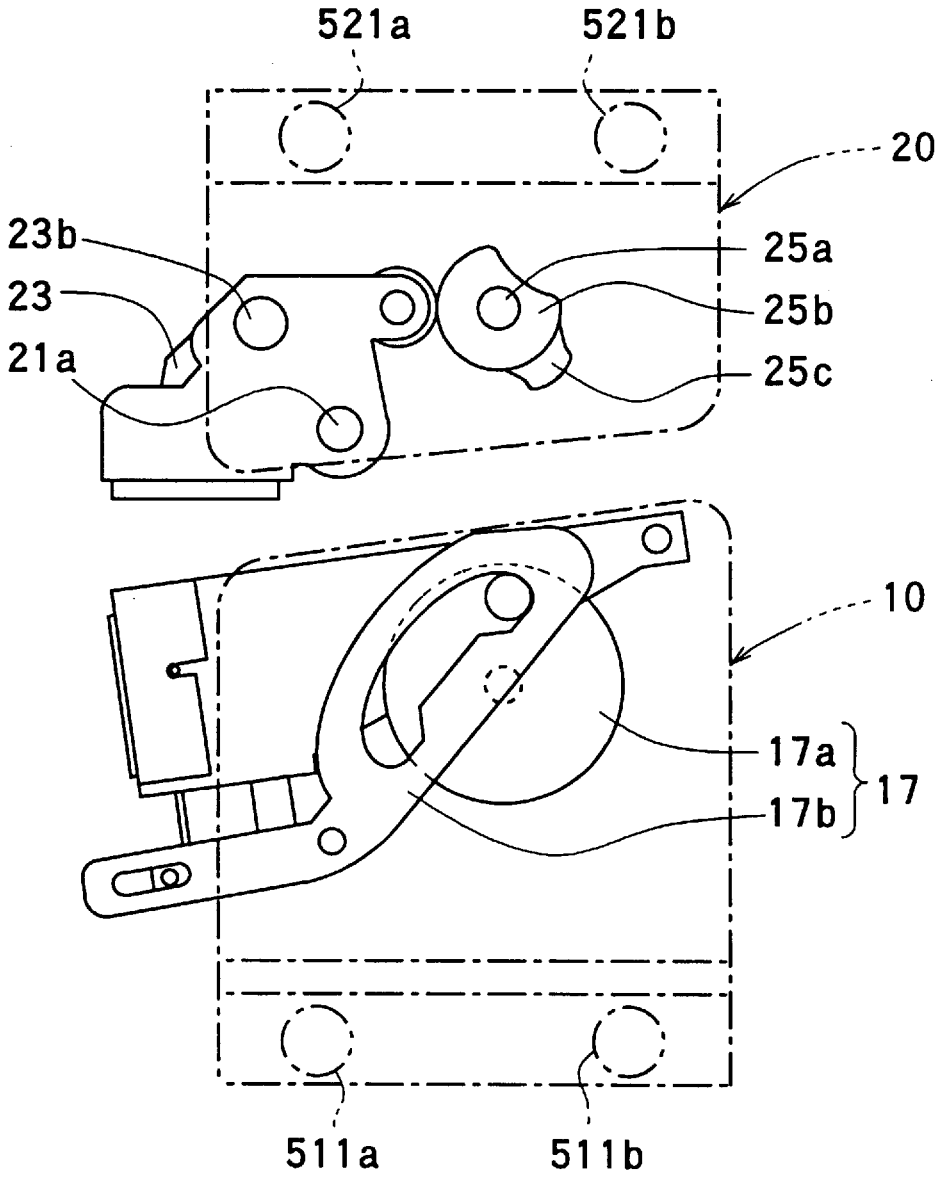
FIG. 13 is a front view schematically showing the other embodiment of the present invention.

The other components in the embodiment of FIG. 13 are substantially identical with those in the former embodiments.

Although every position setting means 30 in the foregoing embodiments has the lead screw rods 31 and 32 for moving parallel the staple driver unit 10 and the clinching unit 20, use of such lead screw rod is by no means limitative and any possible means such as an endless belt may be adopted instead.

Figure 14:
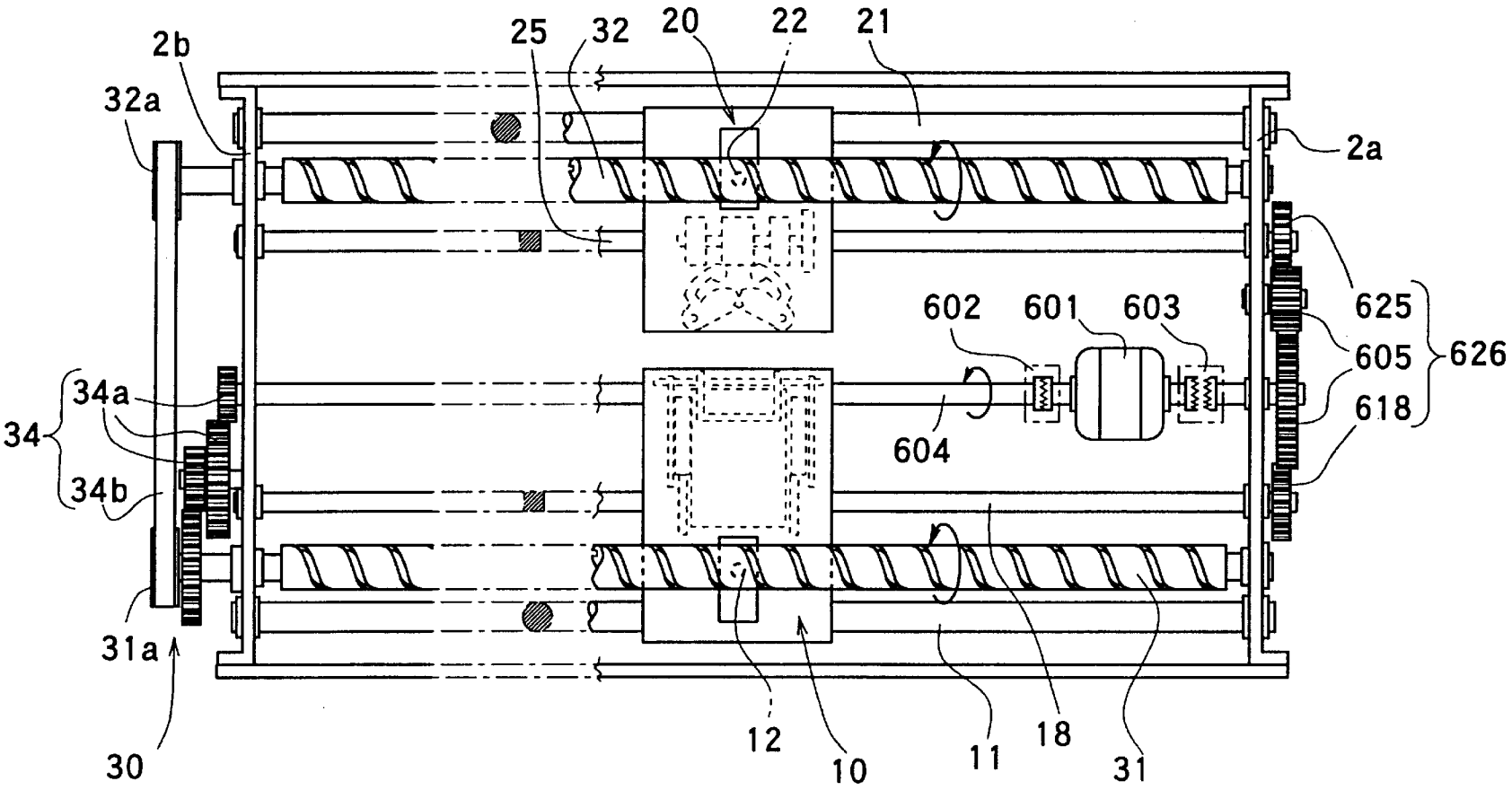
FIG. 14 is a front view schematically showing a modified embodiment of the present invention.

Moreover, the power source for the position setting means 30 and the power source for the stapling drive means 26 may be replaced with a single common motor 601 as illustrated in FIG. 14.

That is, the motor 601 is mounted intervening between connection/disconnection means 602 and 603 such as electromotive clutches on a rotating shaft 604 which is respectively connected to the driver rotating shaft 18 of the staple driver unit 10 and the clinch rotating shaft 25 of the clinching unit 20 through the motion transmission means 34 in the position setting means 30.

Thus, when the motor 601 is operated to rotate in the state of joining the clutch 602 and disconnecting the clutch 603, rotational motion is transmitted to the lead screw rods 31 and 32 through the motion transmission means 34 including the gears 34*a* and the timing belt 34*b*, thereby to move parallel the staple driver unit 10 and the clinching unit 20 in the state of being opposed to each other.

When the motor 601 is operated to rotate in the state of joining the clutch 603 and disconnecting the clutch 602, rotational motion is transmitted to the driver rotating shaft 18 and the clinch rotating shaft 25 through the stapling transmission means 626 including a series of gears 605 and the gears 618 and 625, thereby to carry out the desired stapling operation.

According to this embodiment, the functions of moving parallel the staple driver unit 10 and the clinching unit 20 and carrying out the stapling operation can be established by only one power source.

Although the illustrated embodiment is actualized on the premise that a rotational driving system including an electric motor is employed as the power source 26*a* for the stapling drive means 26, a linear driving system formed of an electromagnetic solenoid and so forth may be used instead. Likewise, this embodiment employs an electric rotating motor as the power source 33 for the position setting means 30, but a linear motor or the like may be used instead.

As is apparent from the foregoing description, the present invention makes it possible to obtain the simple and light automatic stapling device in which the staple driver unit and the clinching unit opposed to each other astride the sheet passage can be operated by the stapling drive means incorporating the single power source. Besides, according to this invention, stable coordinated movements of the staple driver unit and the clinching unit can be performed precisely with exquisite timing during the stapling operation.

Furthermore, according to the invention, since the coordinated movements of the staple driver and clinching units can be performed by a single driving system including motion transmitting means as stated above, the stapling device has no need for driving means reliant on a complicated control system including a high-level servo mechanism, as a result of which the stable stapling operation can be performed for a long time.

Still more, the automatic stapling device according to the invention is applicable to not only an image producing device such as a printer and a copying machine, but also all sorts of document handling devices. Thus, the invention brings about marked effects in that a high-speed bookbinding or document finishing system capable of being handled with ease can be constituted.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An automatic stapling device comprising:

a staple driver unit for inserting a staple into piled sheets placed in a sheet passage to permit said staple to pierce the sheets;

a clinching unit opposed to said staple driver unit for bending said staple piercing the sheets;

stapling drive means incorporating a single power source for producing motive power to operate said staple driver unit to insert said staple into the sheets and said clinching unit to bend said staple piercing the sheets; and means for transmitting the motive power generated by said stapling drive means to said staple driver unit and clinching unit, respectively;

wherein said staple driver unit and said clinching unit are separated by a space defining said sheet passage therebetween, said sheet passage permitting the sheets to pass therethrough.

2. An automatic stapling device according to claim 1, further comprising position setting means for parallel moving said staple driver unit and said clinching unit synchronously and placing said staple driver unit and said clinching unit in a stapling position prescribed on said sheets.

3. An automatic stapling device according to claim 2, wherein said position setting means includes one position-setting power source for generating rotational motion, and a pair of lead screw rods synchronously rotatable with the rotational motion given by said position-setting power source, so as to parallel move said staple driver unit and said clinching unit while being opposed to each other by said lead screw rods.

4. An automatic stapling device according to claim 2, wherein said staple drive unit and said clinching unit each are supported slidably by one or more guide rods.

5. An automatic stapling device according to claim 1, further comprising means for forwarding said sheets to a stapling position.

6. An automatic stapling device for inserting a staple into piled sheets fed in a sheet forwarding direction to bind said sheets, which comprises:

a device frame having side panels opposed to each other perpendicularly to said sheet forwarding direction across a sheet passage, at least one first guide rod arranged perpendicularly to said sheet forwarding direction between said side panels, at least one second guide rod arranged perpendicularly to said sheet forwarding direction between said side panels, a staple driver unit slidably supported by said at least one first guide rod for causing the staple to be inserted into said sheets and pierce the sheets, a clinching unit slidably supported by said at least one second guide rod and opposed to said staple driver unit for bending said staple piercing the sheets, stapling drive means incorporating a single power source for generating motive power to operate said staple driver unit so as to insert said staple into the sheets and said clinching unit so as to bend said staple piercing said sheets, transmission means for transmitting the motive power generated by said power source to said staple driver unit and said clinching unit, respectively, and position setting means for parallel moving said staple driver unit and said clinching unit synchronously and placing said staple driver unit and said clinching unit in a stapling position prescribed on said sheets.

7. An automatic stapling device according to claim 6, wherein said transmission means includes a driver rotating shaft provided at its one end with a timing wheel, a clinch rotating shaft provided at its one end with a timing wheel, and a timing belt wound around said timing wheels on said driver rotating shaft and said clinch rotating shaft, whereby the motive power generated by said stapling drive means is transmitted respectively to said driver rotating shaft and said clinch rotating shaft through said transmission means.

8. An automatic stapling device according to claim 7, wherein said power source of said transmission means is formed of an electric motor having a driving gear, and said transmission means includes a driving gear disposed on said driver rotating shaft, and a driven gear disposed on said clinch rotating shaft, whereby the motive power generated by said stapling drive means is transmitted respectively to said driver rotating shaft and said clinch rotating shaft through said transmission means.

9. An automatic stapling device according to claim 6, wherein said position setting means includes a lead screw rod disposed between said side panels so as to parallel move said staple driver unit, a lead screw rod disposed between said side panels so as to parallel move said clinching unit, a single rotational power source for generating rotational motion, and means for transmitting the rotational motion generated by said power source to said lead screw rods for said staple driver unit and said clinching unit.

10. An automatic stapling device according to claim 6, wherein said position setting means includes a lead screw rod disposed between said side panels for parallel moving said staple driver unit, a timing wheel disposed on one end of said lead screw rod for said staple driver unit, a lead screw rod disposed between said side panels for parallel moving said clinching unit, a timing wheel disposed on one end of said lead screw rod for said clinching unit, a single rotational power source for generating rotational motion, and transmission means having a timing belt for transmitting the rotational motion generated by said power source to said lead screw rods for said staple driver unit and said clinching unit.

11. A device for stapling piled sheets, which comprises:

a device frame having side panels opposed to each other perpendicularly to said sheet forwarding direction across a sheet passage, at least one first guide rod arranged perpendicularly to said sheet forwarding direction between said side panels, at least one second guide rod arranged perpendicularly to said sheet forwarding direction between said side panels, a staple driver unit with a driver rotating shaft, said staple driver unit being slidably supported by said at least one first guide rod for forming an element wire into a substantially square bracket shape to obtain a staple and causing said staple to be inserted into said sheets and pierce the sheets, a clinching unit with a clinch rotating shaft, said clinching unit being slidably supported by said at least one second guide rod and opposed to said staple driver unit for bending said staple piercing the sheets, stapling drive means incorporating a single power source for generating motive power to operate said staple driver unit so as to insert said staple into the sheets and said clinching unit so as to bend said staple piercing said sheets, transmission means connected to said driver rotating shaft of said staple driver unit and said clinch rotating shaft of said clinching unit so as to transmit the motive power generated by said power source to said staple driver unit and said clinching unit, respectively, and position setting means for parallel moving said staple driver unit and said clinching unit synchronously and placing said staple driver unit and said clinching unit in a stapling position prescribed on said sheets.

12. A stapling device according to claim 11, wherein said transmission means includes a timing wheel disposed on said driver rotating shaft, a timing wheel disposed on said clinch rotating shaft, and a timing belt wound around said timing wheels on said driver rotating shaft and said clinch rotating shaft, said transmission means being mounted on one of said side panels of said device frame so as to transmit the motive power generated by said stapling drive means respectively to said driver rotating shaft and said clinch rotating shaft through said transmission means.

13. A stapling device according to claim 11, wherein said power source of said transmission means is formed of an electric motor having a driving gear, and said transmission means includes a driving gear disposed on said driver rotating shaft, and a driven gear disposed on said clinch rotating shaft, said transmission means being mounted on one of said side panels of said device frame so as to transmit the motive power generated by said stapling drive means respectively to said driver rotating shaft and said clinch rotating shaft through said transmission means.

14. A stapling device according to claim 11, wherein said position setting means includes a lead screw rod disposed between said side panels so as to parallel move said staple driver unit, a lead screw rod disposed between said side panels so as to parallel move said clinching unit, a single rotational power source for generating rotational motion, and means for transmitting the rotational motion generated by said power source to said lead screw rods for said staple driver unit and said clinching unit, said position setting means being mounted on one of said side panels of said device frame.

15. A stapling device according to claim 11, wherein said position setting means includes a lead screw rod disposed between said side panels for parallel moving said staple driver unit, a timing wheel disposed on one end of said lead screw rod for said staple driver unit, a lead screw rod disposed between said side panels for parallel moving said clinching unit, a timing wheel disposed on one end of said lead screw rod for said clinching unit, a single rotational power source for generating rotational motion, and transmission means having a timing belt for transmitting the rotational motion generated by said power source to said lead screw rods for said staple driver unit and said clinching unit, said position setting means being mounted on one of said side panels of said device frame.

16. An automatic stapling device comprising:

a staple driver unit for inserting a staple into piled sheets placed in a stapling position and permitting said staple to pierce said sheets, a clinching unit opposed to said staple driver unit for bending said staple piercing the sheets, position setting means for parallel moving said staple driver unit and said clinching unit synchronously and placing said staple driver unit and said clinching unit in said stapling position, one power source for generating rotational motion, stapling motion transmitting means for transmitting the rotational motion from said power source to said staple driver unit and said clinching unit through a first connection/disconnection means, feeding motion transmitting means for transmitting the rotational motion from said power source to said position setting means through a second connection/disconnection means, whereby rotational motion is transmitted from said power source to said staple driver unit and said clinching unit by joining said first connection/disconnection means and disconnecting said second connection/disconnection means to perform a stapling operation, and rotational motion is transmitted from said power source to said position setting means unit by joining said second connection/disconnection means and disconnecting said first connection/disconnection means to parallel move said staple driver unit and said clinching unit.

17. An automatic stapling device for inserting a staple into piled sheets fed in a sheet forwarding direction to bind said sheets, which comprises:

a device frame having side panels opposed to each other perpendicularly to said sheet forwarding direction across a sheet passage, at least one first guide rod arranged perpendicularly to said sheet forwarding direction between said side panels, at least one second guide rod arranged perpendicularly to said sheet forwarding direction between said side panels, a staple driver unit slidably supported by said at least one first guide rod for causing the staple to be inserted into said sheets and pierce the sheets, a clinching unit slidably supported by said at least one second guide rod and opposed to said staple driver unit for bending said staple piercing the sheets, position setting means for parallel moving said staple driver unit and said clinching unit synchronously and placing said staple driver unit and said clinching unit in said stapling position, one power source for generating rotational motion, stapling motion transmitting means for transmitting the rotational motion from said power source to said staple driver unit and said clinching unit through a first connection/disconnection means, feeding motion transmitting means for transmitting the rotational motion from said power source to said position setting means through a second connection/disconnection means, wherein rotational motion is transmitted from said power source to said staple driver unit and said clinching unit by joining said first connection/disconnection means and disconnecting said second connection/disconnection means to perform a stapling operation, and rotational motion is transmitted from said power source to said position setting means unit by joining said second connection/disconnection means and disconnecting said first connection/disconnection means to parallel move said staple driver unit and said clinching unit along said at least one first guide rod and said at least one second guide rod.

* * * * *